US005974611A

United States Patent [19]

Casella

[11] Patent Number: 5,974,611

[45] Date of Patent: Nov. 2, 1999

[54] INTERLOCKING MULTIPURPOSE AIRTOOL

[75] Inventor: David Wayne Casella, Malaga, Australia

[73] Assignee: Penumatic Systems International Pty Ltd., Malaga W.A., Australia

[21] Appl. No.: 08/849,957

[22] PCT Filed: Dec. 18, 1995

[86] PCT No.: PCT/AU95/00853

§ 371 Date: Aug. 15, 1997

§ 102(e) Date: Aug. 15, 1997

[87] PCT Pub. No.: WO96/18465

PCT Pub. Date: Jun. 20, 1996

[30] Foreign Application Priority Data

Dec. 16, 1994 [AU] Australia ..... PN0126

[51] Int. Cl.[6] ..... B08B 9/04

[52] U.S. Cl. ..... 15/3.52; 15/3.5; 124/56; 173/169; 254/134.4

[58] Field of Search ..... 15/3.5, 3.51, 3.52; 124/56, 59–61, 70, 71; 173/168, 169, 170; 254/134.3 R, 134.3 FT, 134.4

[56] References Cited

U.S. PATENT DOCUMENTS

| | | | |
|---|---|---|---|
| 1,806,270 | 5/1931 | Thompson | 15/3.5 |
| 1,867,751 | 7/1932 | Oberhuber | 15/3.5 |
| 3,056,395 | 10/1962 | Merz et al. | 124/71 X |
| 4,429,428 | 2/1984 | Van Dyk | 15/3.52 |
| 4,467,488 | 8/1984 | Creek | 15/3.5 |
| 4,974,277 | 12/1990 | Casella | 15/3.5 |

FOREIGN PATENT DOCUMENTS

| | | |
|---|---|---|
| 49053/90 | 8/1990 | Australia . |
| 92/02310 | 2/1992 | WIPO . |

*Primary Examiner*—Mark Spisich
*Attorney, Agent, or Firm*—Lowe Hauptman; Gopstein Gilman & Berner

[57] ABSTRACT

A multipurpose air tool (1) having a handle (2) to which a head (3) can be removably attached is disclosed. The head (3) has attached thereto various such tools as a face plate (4) and replaceable nozzles (5). The head (3) is interlocked to the handle (2) by a spigot (19) and bayonet connection (21, 23, 34). A safety interlock (16) prevents operation of the trigger (15) and valve (12) unless the head (3) is correctly positioned on the handle.

9 Claims, 5 Drawing Sheets

43
48
15
2

19
42
22
23
21
3
4

19
42
22
23
21
3
4
44

42
20
19
23
22
21
3
4
44

INTERLOCKING MULTIPURPOSE AIRTOOL

This invention relates to an interchangeable assembly between a hand piece and multi attachments, of which each attachment when attached to the hand piece gives the invention a variety of purposes, such as one attachment is a pressure purging device used to launch pellets for purposes of purging or cleaning tubes, pipes, conduits and hoses, another attachment is the spool attachment which allows for the projection of a cord attached to a pellet through pipes, tubes, conduits or hoses.

BACKGROUND OF THE INVENTION

Contamination of hoses, tubes, pipes and conduits represents a major problem to industry as it directly causes major plant and machinery breakdowns requiring extensive repairs at a cost which is impossible to measure. The smaller the internal diameter of the hose, tube or pipe, the greater is the potential for damage caused by the presence of contaminants due to the inability to effectively clean these small diameter tubes.

Thus a system which effectively removes contamination from tubes, pipes, conduits and hoses, arising from use, or from manufacture, cutting and fitting of new assemblies is required. It is evident that a method is required to overcome the problems caused by the extensive component and system malfunctions due to particles of contamination. The traditional methods such as using pull-throughs, bowing out the lines with air or flushing with oil, solvents or chemicals are inefficient. Frequently these methods involved substantial labour and material costs. Solvents and chemicals utilised in the process represented a hazard to the user and often created disposal problems, having regard to the toxicity of the chemicals with environmental concerns.

It is known that the complex task can be achieved by propelling a foam pellet through a hose, pipe, conduit or tube to be cleaned. The pellet is slightly larger in external diameter than the internal diameter of the hose, pipe, conduit or tube and consequently the pellet expands against the internal surface thereby eliminating the contaminants as it passes through. irrespective of whether they are liquid or solid.

U.S. Pat. No. 4,974,277 of which David Wayne Caseila is the inventor, describes a hand held pneumatic gun which has a breech pivoted to the gun, that is a hinged face plate, that can be opened to allow the nozzle size to be changed and the projectile inserted therein. That gun has no adequate safety mechanism, and is limited in its use to a small range of diameter hoses and pipes, and comprises of one assembly and does not have the interlocking multi-purpose assembly. Application Ser. No. AU663294 (83338/91) Is an Improvement on U.S. Pat. No. 4,974,277 and has the exact same limitations.

It is the object of this invention to provide a multi-purpose pneumatic tool having a multi function hand piece with interchangeable attachments or heads. One such attachment is the pressure purging which is easily adapted to a wide range of internal diameters of pipes, tubes or hoses, and another is the spool head.

Also it is an object of the invention to provide a wide range of heads which will be adapted to separate and different tasks but each will be interchangeable with the interlocking assembly.

The multi function hand piece, by using an unique interlocking assembly, can be used for a variety of different purposes by the attachment of devices for cleaning for pipes, tubes and hoses, a spooling attachment, and other attachments such as a venturi system for sand blasting or the extraction of the addition of liquids to the air stream, an air drill, and pressure testing of pressure systems.

An additional object of the invention is to provide a safety device, both automatic and manual to prevent the operation of the hand piece unless the attachment or head is correctly positioned and affixed by the interlocking assembly between the multi function hand piece and attachment or head.

BRIEF DESCRIPTION OF THE DRAWINGS

In order to more fully describe the invention, reference will now be made to the accompanying drawings in which.

BRIEF DESCRIPTION OF THE INVENTION

There is provided according to the invention an interlocking multipurpose air tool comprising a multi function handle, a connection in the handle for the connection to a supply of compressed air, a trigger actuating a valve in the handle for controlling the flow of compressed air, characterised in that said air tool includes a head, interlocking means removably connecting said head to the said handle, an attachment connected to said head, said attachment connecting said air supply to a point of use, and a safety lock between said head and said handle to prevent the operation of the trigger until the head is correctly positioned on said handle, whereby the said head can carry one of a plurality of attachments depending on the use to which the airtool is put.

Preferably the interlocking mechanism comprises a hollow spigot for the passage of air therethrough interconnecting the said head and said handle, and a bayonet connection therebetween including a headed pin and arcuate slot, said arcuate slot having a radius of curvature centred on the hollow spigot whereby relative rotation between the said head and said handle locks said pin in said arcuate slot.

Preferably also the head has a hinged face plate attached thereto, said face plate having an aperture to receive one of a plurality of nozzles for launching pellets through a pipe, hose, tube or conduit.

DESCRIPTION OF THE PREFERRED EMBODIMENTS

Figure 1:
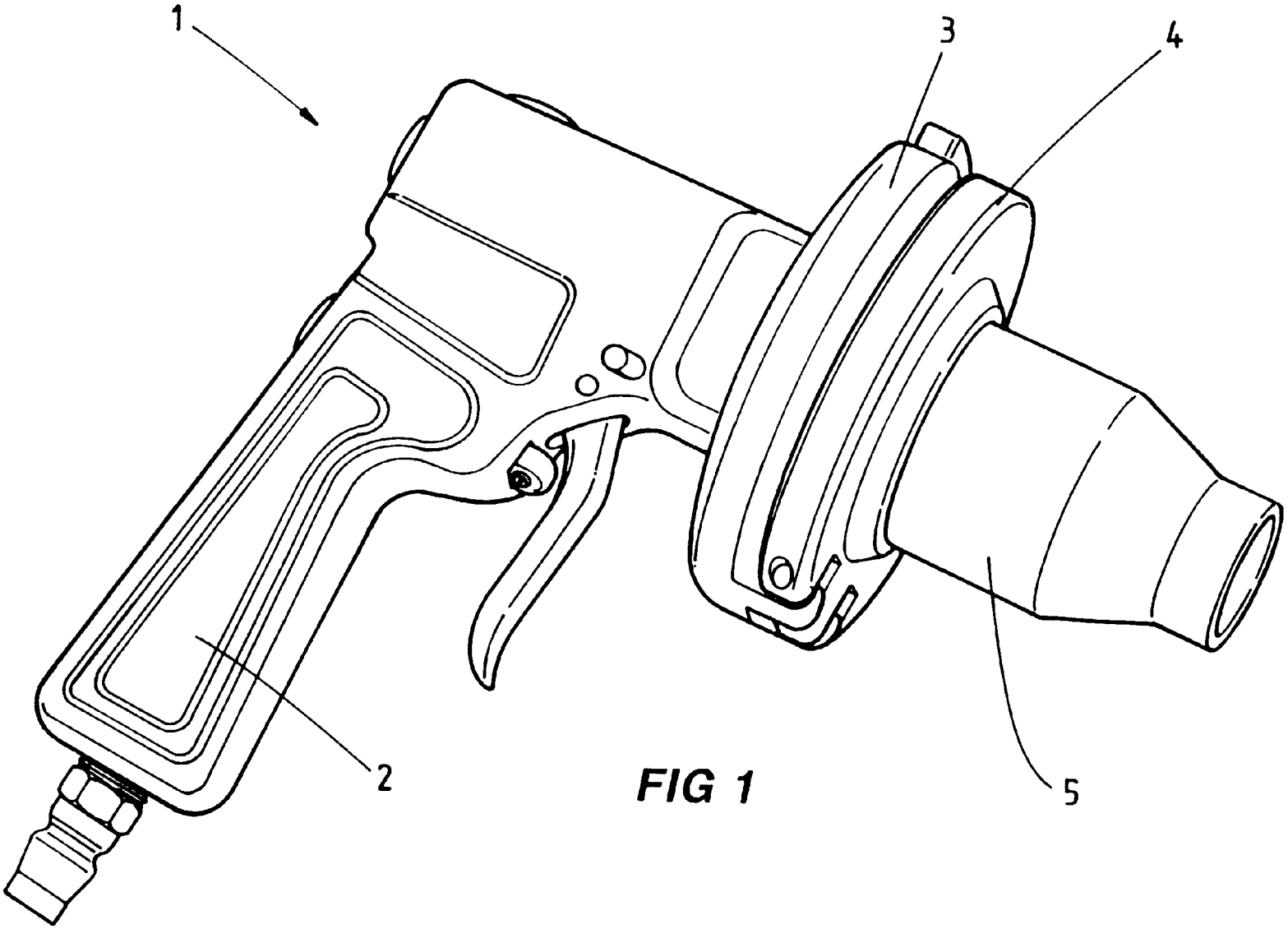
FIG. 1 is a perspective view of the hand piece interlocked to the launcher head.
Figure 2:
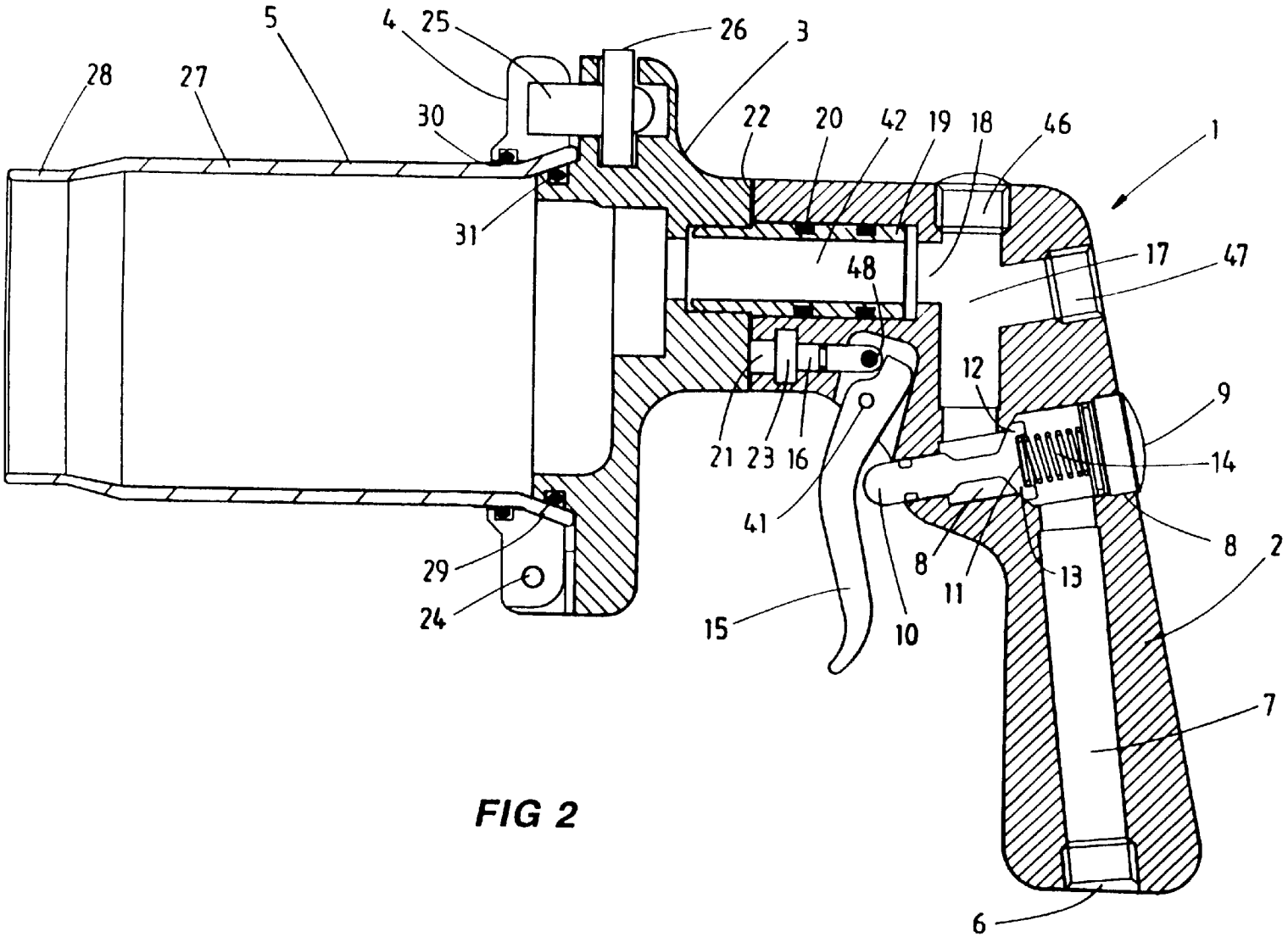
FIG. 2 is a cross sectional view of one form of the invention, FIG. 3 (*a*) shows a view of the handle with the head detached, and views (*b*), (*c*) and (*d*) each show a detached head and face plate of varying sizes to accommodate various sized nozzles and thus projectiles.
Figures 3A, 3B, 3C, 3D:
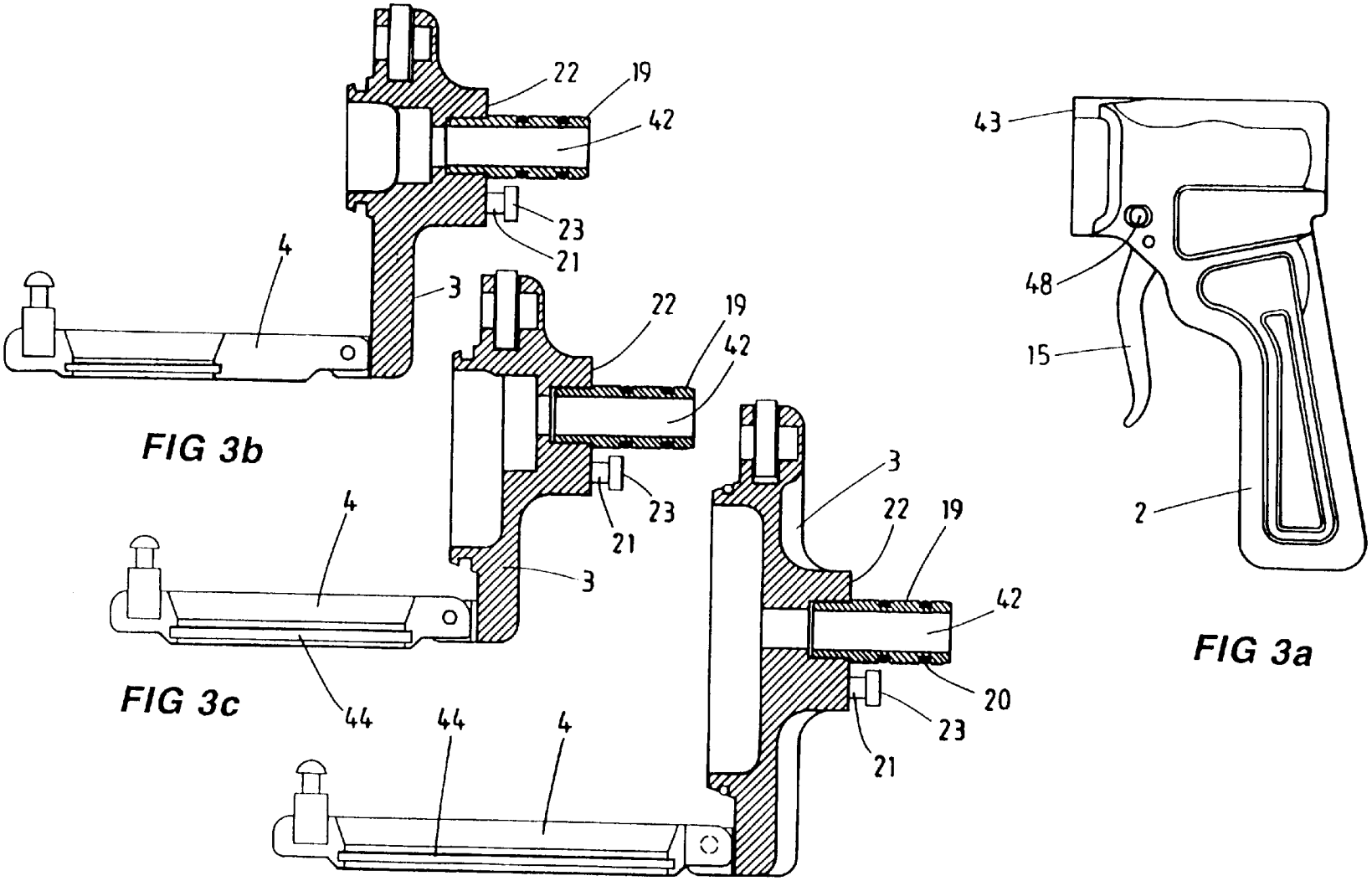

Referring firstly to FIG. 1, there is shown a general arrangement of the invention. The launcher 1 has two main components comprising a multi function handle 2. and a head 3. In this example the head has pivoted thereto a face plate 4 with a nozzle 5.

The handle 2 has a connection 6 to which the compressed air supply may be connected, the connection opening to a passage 7 connecting to passage 8 which is closed by a plug 9 at one end and closed by a valve 11 having a valve stem 10, the valve having a sealing ring 12 engaging on a seat 13 formed in the handle. The valve 11 is biased to the closed position by a spring 14. The valve stem 10 is engaged by a trigger 15. Preferably the valve 11 is designed such that the operator does not have to hold the valve in the open position against the air pressure which can be 250 PSI or more. Thus the valve is designed as a pressure assist valve or a balanced valve so that as equal air pressure is exerted on both sides of the valve, the user thus only has to act against the spring pressure of spring 14.

The trigger 15 is pivoted to the handle 2 by pivot pin 41 and also engages the end of a safety lock 16. the operation of which will be described in more detail later.

Figure 5:
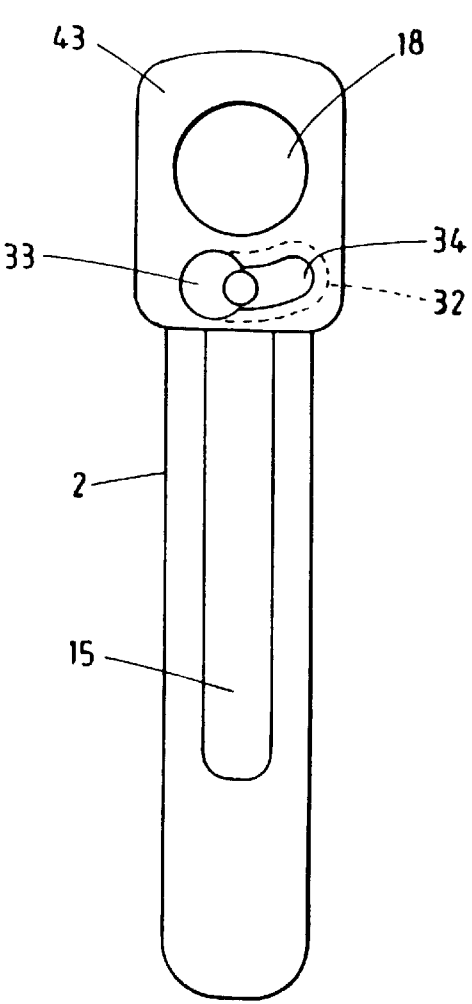
FIG. 5 is a view of the face of the handle to which the head is attached, and shows the head part of the interlocking assembly.

The valve 11 controls the flow of compressed air into passage 17 opening to passage 18 leading to the head 3. The head 3 has a hollow spigot 19 with a through passage 42 which seals by sealing rings 20 into the passage 18. The head 3 is detachable from the handle 2 and is retained in position by a bayonet form of connection comprising an attaching pin 21 attached to the face 22 of the head. As shown in FIG. 5 the end face 43 of the handle has a recessed arcuate slot 32 extending from hole 33 to receive the pin 21 and its enlarged end forming a head 23. The arcuate slot has its radius of curvature extending from the centre line of the spigot 19. The slot 32 has an arcuate opening 34 of lesser width than the slot 32, the hole 33 having a diameter to receive the head 23 and the arcuate opening 34 has a width to allow the pin to pass there along, the head 23 being retained in the slot. To join the head 3 to the handle, the spigot 19 is inserted in the passage 18. and the pin 21 and its head 23 in the hole 33. Rotation of the head 3 about the spigot 19 relative to the handle 2 then securely locks the head 3 to the handle 2 by the flange 23 engaging in the arcuate slot 32, the face 22 of the head being in contact with the face 43 of the handle.

The safety lock 16 in the handle 2 is adapted to extend from the face 43 of the handle when the trigger is actuated. However unless the head is correctly located in position the safety lock cannot protrude for it will engage against the face of head 23. Thus this safety lock ensures that the head must be correctly positioned before the trigger can open the valve to prevent the inadvertent operation of the valve, for the air pressure may cause the head to be thrown from the handle with great force if not secured in position.

The face plate 4 is hinged to the head 3 by hinge pins 24, and on the opposite side has a latch pin 25 to engage in a key lock 26 on the head 3. The face plate 4 has an opening 44 to receive a nozzle 5 which in this example has a cylindrical portion 27 tapering to a discharge opening 28. At the other end the nozzle has a flared portion 29. Seating rings 30 provided on the face plate engage the nozzle when the nozzle is positioned in the face plate, and sealing rings 31 are also positioned on the head to seal against the nozzle when in use. Thus the nozzle is sealed against the face plate and also against the head.

In use of this embodiment of the invention, to attach the nozzle, the face plate is opened by depressing key lock 26 thereby unlocking the face plate from the head so that it swings away from the head. The nozzle is then inserted through the opening in the face plate and pushed so as to be seated on the sealing rings.

The cleaning pellet is then inserted into the nozzle, the face plate is closed and the flange on the nozzle sealing against sealing rings on the head.

In use the of this embodiment the nozzle is applied to the end of the hose, pipe or tube (to be cleaned of its contaminants) and held tightly against the end of the hose, tube or pipe. A firm pressure is all that is required. The trigger is then actuated and the air pressure forces the pellet through the hose. tube or pipe. The pellet will traverse curves and bends, even right angled elbow bends and also travel through ball and other straight-through valves. If the hose, tube or pipes comprise a number of branches and alternate routes, if all the routes are closed except the route to be cleaned, (which is opened to atmosphere) the pellet will follow that route to atmosphere. The pellet is preferably a compressible foam material and can be recovered at the end of the hose, tube or pipe.

To remove the head from handle. the manual locking pin lever 48 is moved rearwardly thus disengaging locking pin 16. The head 2 is then partially rotated to disengage the pin head 23 from arcuate groove in the handle, the head 2 then being moved axially to extract the spigot from the passage in the handle.

Figure 4B:
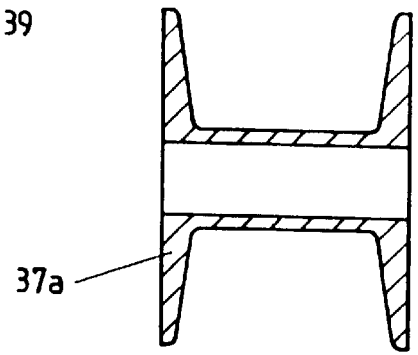
FIG. 4 (*a*) shows a further form of head with face plate removed, the head containing a fixed spool, while FIG. 4 (*b*) shows a free running spool to replace the fixed spool.
Figure 4A:
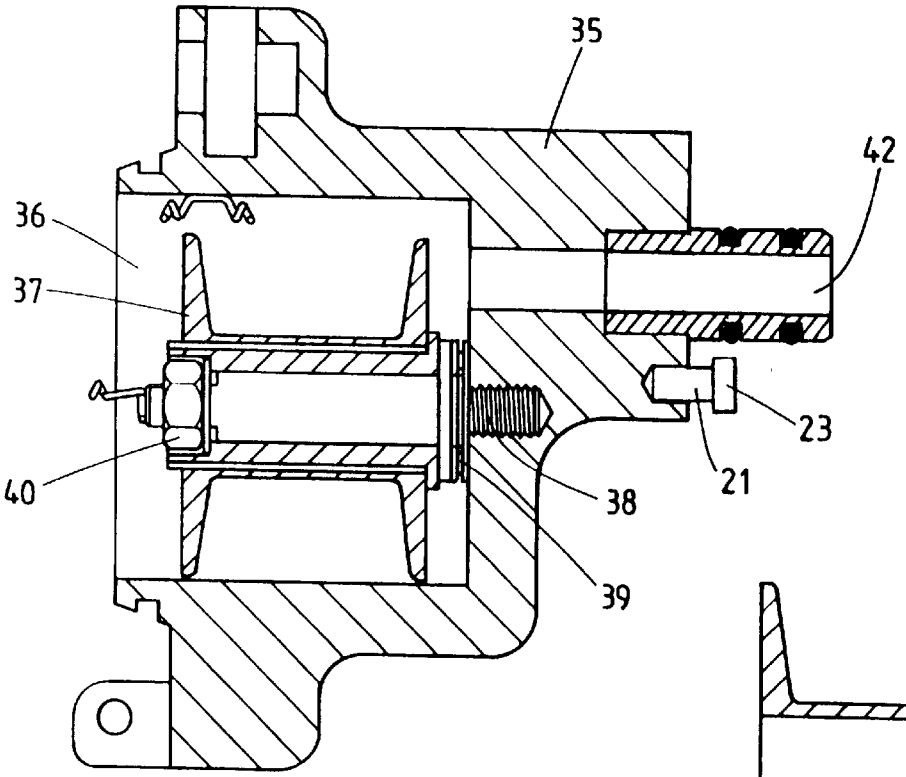
Figure 6A:
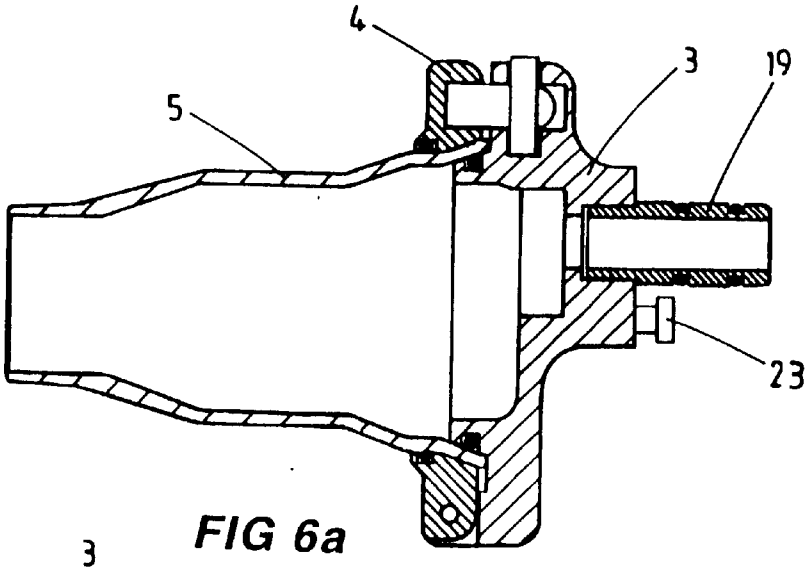
FIGS. 6 (*a*) and (*b*) show examples of the head and face place with nozzles of differing sizes.
Figure 7:
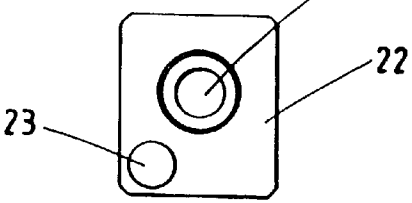
FIG. 7 is a rear view of the head portion which contacts the handle and shows the head part of the interlocking assembly.
Figure 6B:
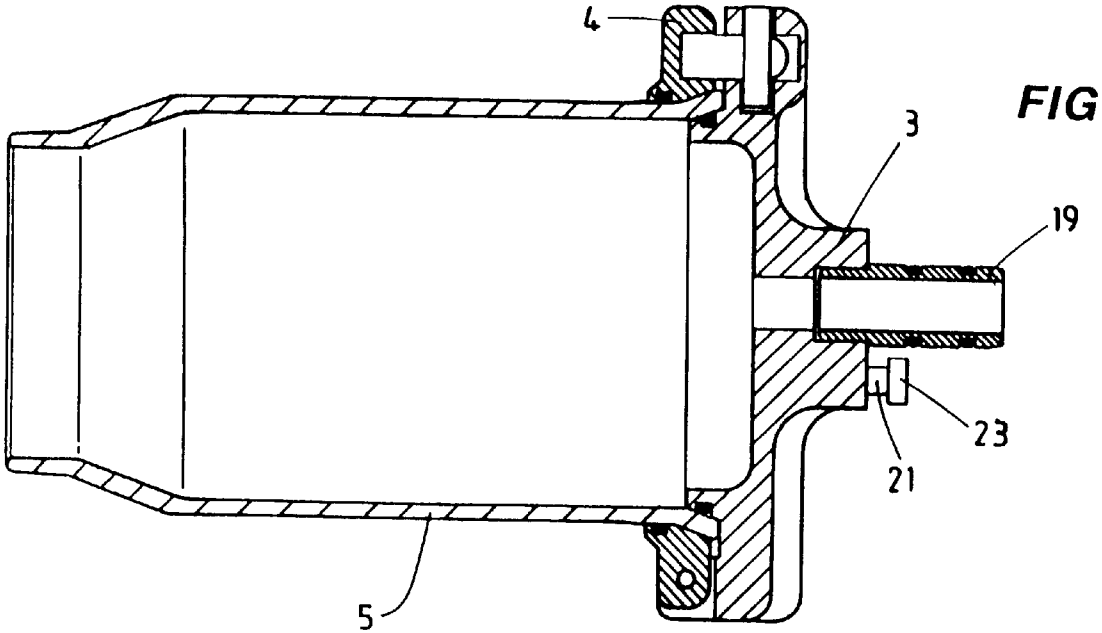

As shown in the drawings the detachable head can be manufactured in various sizes, for example, (a) 2 mm–32 mm range, (b) 32 mm–55 mm range and (c) 60 mm–80 mm range. For the oil industry the size could be up to 150 mm. Thus each size of head can acconmmodate a range of nozzles, the nozzles having a flange to fit the head and tapering to the required diameter for the particular situation. Also In the range of nozzles, the end of the nozzle which is required to engage the end of the hose, tube or pipe can be contoured appropriately depending on the shape fitting on the end of the hose, tube or pipe, for example whether the end is flared, has a threaded end, or has a square end. Examples of the face plate and nozzles are shown in FIGS 6*a* and 6*b*.

Where it is required that wires, cables or the like be threaded through a pipe tube or conduit, the invention also provides provision for the projectile have attached thereto a line which is then drawn through the pipe tube or conduit by the pellet. Reference to FIG. 4*a* shows an example of a head 3 which is formed with a cavity 36 having a spool 37 on a shaft 38. The spool can contain a length of fine line or thread, the tree end of which is attached to the pellet. The face plate (not shown) is pivoted to the head as above described. The air flows through the passage 42 into the cavity 36 around the spool and through the nozzle attached to the face plate driving the pellet with the line attached thereto through the tube or conduit.

FIG. 4*a* shows a rotatable spool with the line being fed through guides as it is fed from the spool. The spool illustrated in FIG. 4*a* is rotatable and an adjustable brake 39 is provided to prevent over run of the spool when the pellet reaches the end of its travel. An adjustment such as a nut 40 provides the required adjustment so that the braking does not provide undue resistance to the travel of the pellet, but still prevents over run of the spool. FIG. 4 (*b*) shows an example of a fixed spool without a brake, and the nut can be lightened to prevent rotation, or alternatively the spool can be mounted on the shaft by splines or the, shaft having a flat with the bore in the spool having a complimentary shape.

The handle has openings 46 and 47 which are closed by plugs but which can be connected to a pressure gauge, or a pressure relief valve, or other systems such as a venturi system.

While the above describes a multipurpose handle to which the heads of the pellet launchers can be attached, it is to be realised that other heads can be part of other devices and units other than pellet launchers, Thus other devices such as line pressure testers, dusters, air drills and the like can be provided with heads as above described and are adapted to be attached to the multipurpose handle. Thus the user may only have one multipurpose handle and a range of heads forming part of the various devices.

Thus it will be seen that there is provided according to the invention a multipurpose handle forming an air tool, it is easily able to accommodate for a wide range of hose, tube or pipe diameters, simply by changing the nozzles, and also by using the appropriate sized head. The safety lock on the handle ensures that inadvertent operation of the trigger while attaching the head is prevented.

Although various forms of the invention have been described in some detail the invention is not to be limited thereto. but can include variations and modifications falling within the spirit and scope of the invention.

I claim:

1. An interlocking multipurpose air tool comprising a multi function handle, a connection in the handle for the connection to a supply of compressed air, a trigger actuating a valve in the handle for controlling the flow of compressed air, characterised in that said air tool includes a head, interlocking means removably connecting said head to the said handle, by relative rotation of the head to the handle, an attachment connected to said head, said attachment connecting said air supply to a point of use, and a safety lock between said head and said handle to prevent the operation of the trigger until the head is correctly positioned on said handle, said safety lock engaging a position of the head when not correctly positioned by the relative rotation of the head whereby the said head can carry one of a plurality of attachments depending on the use to which the airtool is put.

2. An air tool as defined in claim 1 wherein the interlocking means comprises a hollow spigot for the passage of air there through interconnecting the said head and said handle, and a bayonet connection there between including a headed pin and arcuate slot, said arcuate slot having a radius of curvature centred on the hollow spigot whereby relative rotation between the said head and said handle locks said pin in said arcuate slot.

3. An airtool as defined in claim 2 wherein the handle has a face contacting said head, a passage opening to the face and communicating with said valve, a surface on said head to contact said face on the handle and said hollow spigot extending from said surface adapted to sealingly engage in said passage whereby said head is connected to the handle by insertion of the spigot into said passage and partial rotation of the head relative to the handle to lock the head to the handle.

4. An airtool as defined in claim 3 wherein said headed pin extends from said surface, said pin being adapted to engage in said arcuate slot in the face of said handle.

5. An airtool as defined in claim 4 wherein said arcuate slot has an opening at one end thereof to receive said headed pin, said arcuate slot having edges extending from said opening spaced to receive said pin whereby said edges prevent said headed pin from passing out of said slot.

6. An airtool as defined in claim 2 wherein said safety lock comprises a locking pin pivoted from said trigger, said locking pin extending from the face of the handle when the head is correctly positioned on the handle and when said trigger is operated or when a manual locking pin lever is applied, and said locking pin engaging the said surface of the head when the head is not correctly positioned thus preventing operation of the said trigger.

7. An airtool as defined in claim 1 characterised in that one said attachment is a pressure purging device to launch pellets to purge or clean a tubular member, said head having pivoted thereto a face plate to replaceably receive a nozzle for the said pellet.

8. An airtool as defined in claim 7 wherein said face plate has a central passage to receive said nozzle, said nozzle sealing on the face plate.

9. A device as defined in claim 7 wherein said head has a recess to receive a spool of line or thread, the free end of the line or thread connected to said pellet, whereby on operation of the device the pellet will draw the thread through the tubular member.

* * * * *